US005118921A

United States Patent [19]

Aota

[11] Patent Number: 5,118,921

[45] Date of Patent: Jun. 2, 1992

[54] METALLIC SHEATH HEATER WITH IMPROVED ELECTRICAL CONNECTION BETWEEN COIL AND SHEATH AND METHOD OF MANUFACTURE THEREOF

[75] Inventor: Takashi Aota, Saitama, Japan

[73] Assignee: Jidosha Kiki Co., Ltd., Tokyo, Japan

[21] Appl. No.: 678,492

[22] Filed: Apr. 1, 1991

[30] Foreign Application Priority Data

Apr 16, 1990 [JP] Japan ..... 2-97579

[51] Int. Cl.[5] ..... H05B 3/48; H01C 1/03; F23Q 7/00

[52] U.S. Cl. ..... 219/270; 29/611; 29/613; 123/145 A; 219/534; 219/541; 219/544; 219/553; 338/238; 338/241

[58] Field of Search ..... 219/270, 544, 552, 553, 219/534, 541; 338/238-241; 123/145 R, 145 A; 29/611, 613

[56] References Cited

U.S. PATENT DOCUMENTS

| | | | |
|---|---|---|---|
| 2,252,122 | 5/1966 | Baxter | 361/266 X |
| 2,672,546 | 3/1954 | Klinger et al. | 123/145 R |
| 2,898,571 | 8/1959 | Moule et al. | 338/238 |
| 3,158,787 | 1/1964 | Testerini | 123/145 A |
| 4,423,309 | 12/1983 | Murphy et al. | 219/270 |
| 4,476,378 | 10/1984 | Takizawa et al. | 219/270 |
| 4,477,717 | 10/1984 | Walton | 219/270 X |
| 4,556,781 | 12/1985 | Bauer | 219/270 |

FOREIGN PATENT DOCUMENTS

| | | | |
|---|---|---|---|
| 3003799 | 8/1981 | Fed. Rep. of Germany . | |
| 3539970 | 5/1987 | Fed. Rep. of Germany | 219/270 |
| 42-14989 | 9/1967 | Japan . | |
| 57-58017 | 4/1982 | Japan . | |
| 58-21 | 1/1983 | Japan . | |
| 63-64690 | 12/1988 | Japan . | |

*Primary Examiner*—Anthony Bartis
*Attorney, Agent, or Firm*—Townsend & Townsend

[57] ABSTRACT

A sheath heater includes a metal sheath, a coil-like heater, and a heat-resistant insulating powder. The starting form of the metal sheath has a small-diameter cylindrical portion at its distal end and is formed to have a substantially tubular shape as a whole. The heater is fabricated by inserting the coil-like heater in the sheath. The heat-resistant insulating powder is charged in the sheath and holds the coil-like heater in the sheath so that the coil-like heater is electrically insulated from the sheath. The distal end portion of the sheath is melted and so that the confronting end of the coil-like heater is buried so as not to be exposed on the outer wall of a closing portion at the distal end of the sheath. The melting of the sheath end can be done by using plasma, electron-beam or laser welding techniques.

9 Claims, 4 Drawing Sheets

METALLIC SHEATH HEATER WITH IMPROVED ELECTRICAL CONNECTION BETWEEN COIL AND SHEATH AND METHOD OF MANUFACTURE THEREOF

BACKGROUND OF THE INVENTION

The present invention relates to a sheath heater serving as a heating element in a sheath type glow plug used to preheat a sub combustion chamber or a combustion chamber of a diesel engine and a method of manufacturing the same and, more particularly, to improvements in a connection structure between a sheath and a coil-like heating wire (to be referred to as a heater coil hereinafter) and a method of connecting the sheath and the heater coil.

In general, since starting properties at a low temperature are poor in a diesel engine, a glow plug is provided in a sub combustion chamber or a combustion chamber, and a current is flowed to the glow plug to generate heat, thereby improving the ignition properties of the engine by increasing an intake air temperature or using the glow plug as an ignition source. An example of a conventional glow plug of this type is a sheath type glow plug as disclosed in, e.g., Japanese Patent Laid-Open No. 57-58017 or Japanese Patent Publication No. 63-64690. This conventional sheath type glow plug includes a sheath heater in which a heater coil consisting of an iron-chromium alloy or the like (or a combination of a heater coil and a resistive element consisting of, e.g., pure nickel having a large positive resistance temperature coefficient and connected in series with the heater coil as a power control element) is inserted in a sheath consisting of a heat-resistant metal material such as stainless steel such that one end of the heater coil is connected to the distal end portion of the sheath and the other end of the heater coil is connected to the distal end of an electrode rod inserted from the distal end portion of the sheath, and a heat-resistant insulating powder such as magnesia is charged in the sheath.

To fix the heater coil at the sheath distal end portion in the conventional sheath type glow plug having the above arrangement, a cap as an independent member to be fitted in and integrated with an opening at the distal end portion of the sheath is generally used, as disclosed in Japanese Patent Laid-Open No. 58-21. However, a fitting of this cap in the sheath distal end portion is cumbersome, and the workability of spot-welding the heater coil to the cap is poor. Therefore, it is difficult to automatically assemble such a sheath heater. In addition, this conventional structure is complicated because the number of constituting parts is large, and the manufacture of the structure is cumbersome because the heater coil must be formed to have a to-be-welded end extending from the distal end of the coil and to be welded to the cap.

In addition, Japanese Patent Publication No 42-15989 or West Germany Patent No. 3,003,799 discloses a well-known conventional sheath heater having a structure in which, as shown in FIG. 6A, a small hole 1*a* is formed in the distal end portion of a sheath 1 as described above, the distal end portion of a heater coil 2 is inserted into the small hole la from inside to project outside the sheath 1, and this projecting portion is melted and connected by welding. However, this sheath heater poses problems in durability in that, for example, a connection portion 3 (FIG. 6C) obtained by this connecting method is broken by oxidation after repetitive use of the glow plug.

The present inventor has made extensive studies and researches on the problem of durability in the connection portion 3 of the above conventional sheath heater and found that in the connection portion 3 formed at the distal end portion of the sheath 1 by welding the sheath 1 and the heater coil 2 according to the above conventional connecting method, as shown in FIGS. 6B and 7A, an unnecessarily large amount of a heater coil member consisting of an iron-based material is fused and mixed in a surface layer portion of a stainless steel member constituting the sheath 1 to form a fused portion 4 (the content of the coil member is large especially in a portion 4*a* shown in FIG. 7A), and these fused portions 4 and 4*a* between the sheath and coil members are easily oxidized in a relatively short period of time when a high-temperature state is repeatedly caused by heat generated upon application of power to the glow plug. This oxidation is gradually promoted, and the oxidized portions are broken when the high-temperature state is repeated 20,000 to 30,000 times. As a result, holes are formed as shown in FIGS. 6C and 7B, thereby degrading the durability. That is, since a large amount of the iron-based material of the coil 2 is mixed in the stainless steel member of the sheath 1 at the above fused portions 4 and 4*a* between the sheath 1 and the coil 2, the concentration of Ni contained in the sheath member is decreased to degrade the essential durability of the stainless steel member. Therefore, a certain countermeasure is required to solve these problems.

In particular, a strong demand has recently arisen for a so-called afterglow system in which a power supply state to a glow plug is maintained for a predetermined time period after an engine is started, thereby smoothly and properly performing combustion inside the engine. In addition, the operation time of this afterglow system is desired to be prolonged, and various operating conditions such as the heat generation temperature must be more precisely controlled. Therefore, a countermeasure against the above problem of durability caused by oxidation must be made in consideration of these conditions.

SUMMARY OF THE INVENTION

It is, therefore, a principal object of the present invention to provide a sheath heater capable of improving the heat resistance or durability to be much higher than that of a conventional sheath heater and a method of manufacturing the same.

It is another object of the present invention to provide a method of manufacturing a sheath heater, which can easily and reliably weld the distal end portion of a sheath heater to the distal end portion of a sheath.

In order to achieve the above objects of the present invention, there is provided an improved sheath heater comprising a metal sheath having a distal end, a coil-like heater housed in the sheath, and a heat-resistant electrically insulating powder, charged in the sheath, for holding the coil-like heater in the sheath. The distal end portion of the sheath is melted during fabrication of the heater in such a manner that the confronting distal end of the coil-like heater is buried within the melted sheath portion. This eliminates any exposure of any portion of the coil-like heater to the outer surface of the sheath in the finished sheath heater.

During fabrication of the heater, the starting form of the sheath has a small-diameter cylindrical portion at its distal end and the heater coil is arranged in the sheath with the distal end portion of the heater coil inserted in the small-diameter hole of the small-diameter cylindrical portion of the sheath such that the distal end does not project outside the sheath and is located inside the end face of the cylindrical portion. Thereafter, the small-diameter cylindrical portion is melted from outside the sheath distal end portion by plasma welding or the like to close the sheath distal end portion while the distal end portion of the heater coil is connected to the sheath. As a result, the distal end portion of the heater coil is buried in the closing portion formed to close the distal end portion of the sheath by melting, so that the distal end portion of the heater coil is not exposed on at least the outer surface of the sheath distal end portion. Therefore, since oxidation at the sheath distal end portion connected to the heater coil caused by high temperature or the like can be prevented, the durability can be largely improved compared to that of a conventional sheath heater.

DETAILED DESCRIPTION OF THE PREFERRED EMBODIMENT

An embodiment of the present invention will be described below with reference to the accompanying drawings.

Figure 1A:
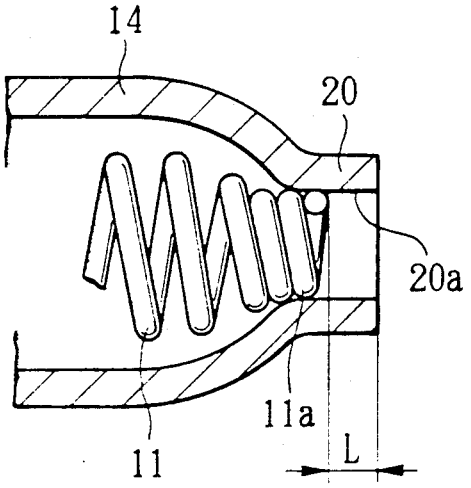
FIGS. 1A and 1B are enlarged sectional views showing a main part of an embodiment for explaining a sheath heater for use in a diesel engine glow plug and a method of manufacturing the same according to the present invention.
Figure 1B:
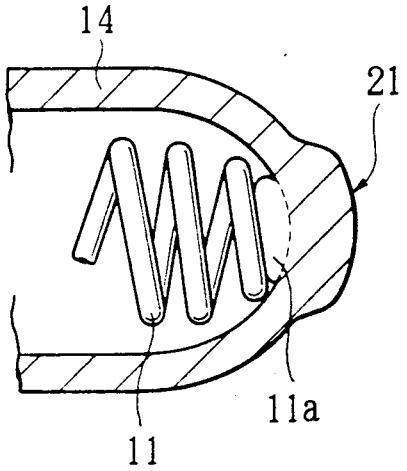
Figure 2:
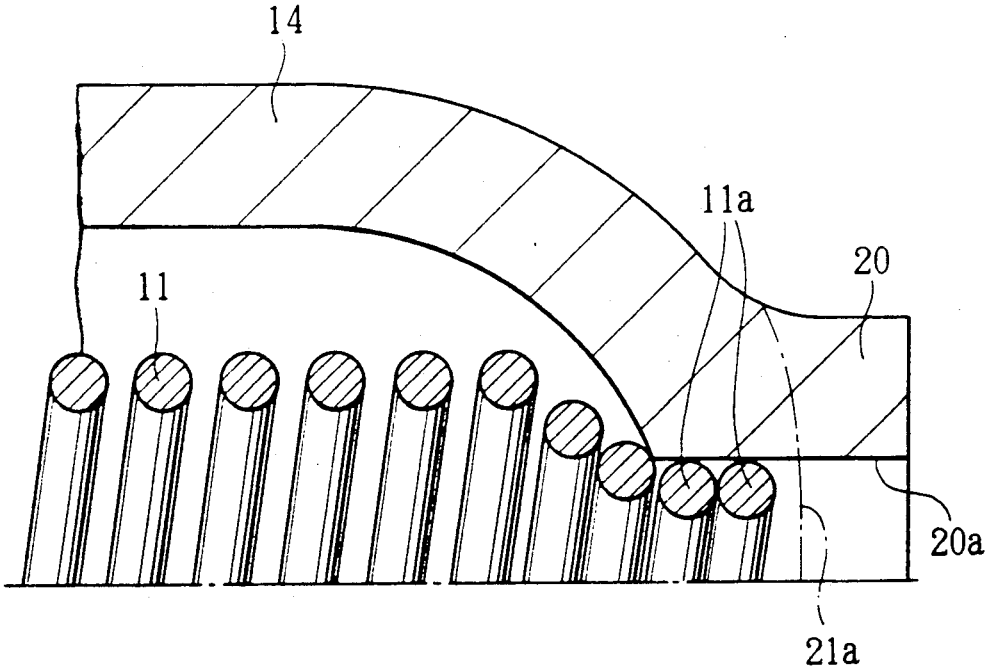
FIG. 2 is an enlarged view showing a main part of an assembly relationship between a sheath and a heater coil, which is a characteristic feature of the embodiment shown in FIGS. 1A and 1B.
Figure 3:
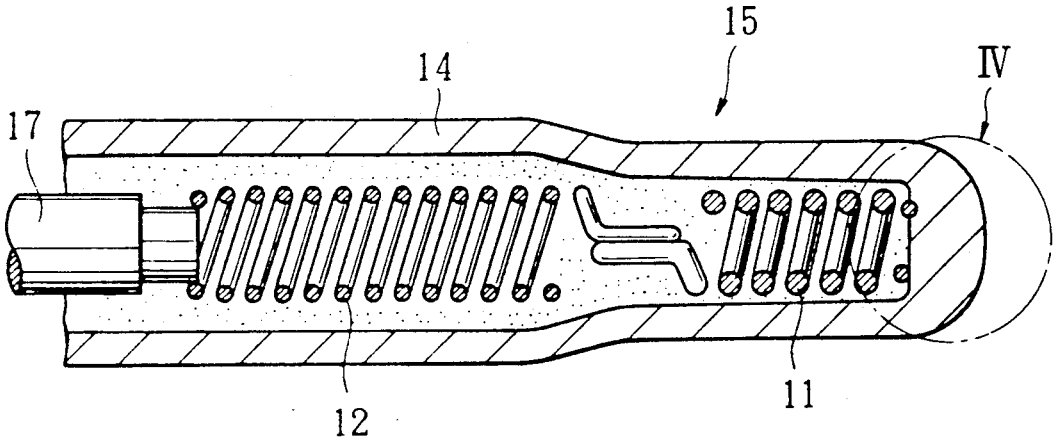
FIG. 3 is a longitudinal sectional view showing a schematic arrangement of the entire sheath heater.

FIGS. 1A to 5 show an embodiment of a sheath heater for use in a diesel engine glow plug and a method of manufacturing the same according to the present invention. A schematic arrangement of a glow plug generally denoted by reference numeral 10 will be briefly described below with reference to FIG. 5. In this glow plug 10, a resistive element 12 as a power control element consisting of, e.g., pure nickel having a large positive resistance temperature coefficient is connected in series with a heater coil 11 as a heating element consisting of, e.g., an iron-chromium alloy material, and the heater coil 11 and the resistive element 12 are buried in a heat-resistant electrically insulating powder 13, such as a magnesia powder charged in a heat-resistant metal sheath 14 consisting of, e.g., stainless steel, thereby constituting a sheath heater 15. The sheath heater 15 is held at the distal end portion of a metal holder 16 having a substantially tubular shape. The distal end of the heater coil 11 is connected to the distal end portion side of the sheath 14, and its other end is connected via the resistive element 12 to the distal end portion side of an electrode rod 17 inserted from the rear end portion of the sheath 14. The electrode rod 17 is externally extracted from the rear end portion of the holder 16. In this embodiment, the thickness and the diameter of the distal end portion of the sheath 14 serving as a heating portion are decreased as shown in FIG. 3 to decrease a heat conduction distance from the heater coil 11 and the like to the sheath outer surface, thereby obtaining rapid temperature rise characteristics to achieve the performance as a fast-heating type glow plug. In addition, the heat capacity in this portion is decreased to reduce power consumption. However, the present invention is not limited to this embodiment. Furthermore, referring to FIG. 5, reference numeral 18 denotes an insulating bush consisting of a synthetic resin or the like and fitted in an annular space portion at the rear end portion of the holder 16 to hold the electrode rod 17; and 18*a* denotes an O-ring to be fitted in the distal end side of the insulating bush 18 to seal the portion. The other arrangements are the same as those conventionally known well.

According to the present invention, to form the sheath heater 15 of the above sheath type glow plug 10 in consideration of durability, a small-diameter cylindrical portion 20, into which a distal end portion 11*a* of the heater coil 11 is inserted and welded, is formed to project from the distal end portion of the metal sheath 14, as shown in FIGS. 1A, 1B, and 2. In addition, the heater coil 11 connected to the distal end portion of the sheath 14 is inserted from inside the sheath 14 such that the distal end portion 11*a* does not project outside the sheath 14 and is located inside a small-diameter hole 20*a* by a distance L shown in FIG. 1A from the end face of the cylindrical portion 20, and the small-diameter cylindrical portion 20 is melted by plasma welding or the like from outside the distal end portion of the sheath 14. As a result, the heater coil distal end portion 11*a* is buried in a closing portion 21 for closing the distal end portion of the sheath 14 so as not to be exposed on the outer surface of the distal end portion of the sheath 14. Note that an alternate long and short dashed line 21*a* shown in FIG. 2 indicates an outline obtained when the small-diameter cylindrical portion 20 is melted by welding to close the distal end portion of the sheath 14.

With this arrangement, the sheath 14 having the small-diameter cylindrical portion 20 at its distal end and the heater coil 11 arranged in the sheath 14 are prepared, and the heater coil 11 is inserted in the small-diameter hole 20*a* formed in the small-diameter cylindrical portion 20 of the sheath 14 such that the distal end portion 11*a* does not project outside the sheath 14 and is located inside the end face of the cylindrical portion 20, as shown in FIG. 2. Thereafter, the small-diameter cylindrical portion 20 is melted by plasma welding or the like from outside the distal end portion of the sheath 14 to close the distal end portion of the sheath 14 while the distal end portion 11*a* of the heater coil 11 is connected to the sheath 14. As a result, the distal end portion 11*a* of the heater coil 11 can be buried in the closing portion 21, formed to close the distal end portion of the sheath 14 by melting the portion, so as not to be exposed on at least the outer surface 21*a* of the distal end portion of the sheath 14. Therefore, oxidation at the distal end portion of the sheath 14 connected to the heater coil 11 caused by a high temperature can be prevented to largely improve the durability compared with those obtained by conventional structures.

Figure 4A:
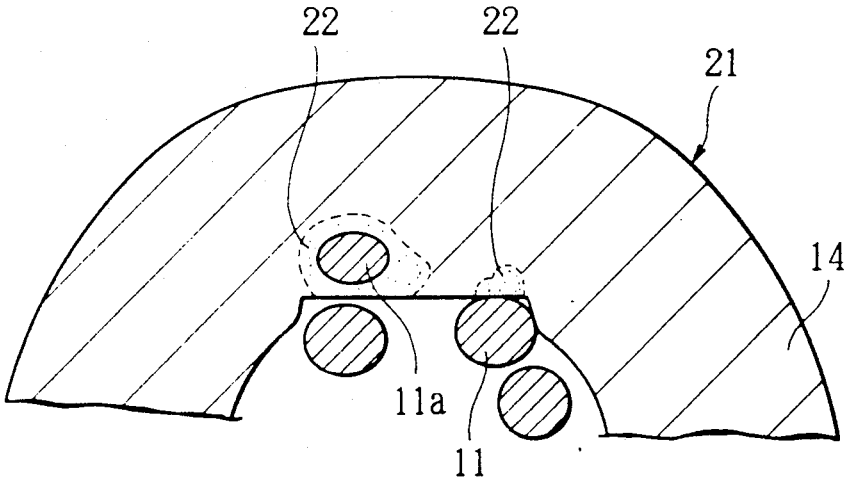
FIGS. 4A and 4B are enlarged sectional views showing states of a portion IV in FIG. 3 obtained before and after a durability test, respectively.

More specifically, according to the manufacturing method of the present invention, the distal end portion 11*a* of the heater coil 11 is connected to the sheath 14 by welding in the state as shown in FIGS. 1A or 2. As a result, as shown in FIG. 4A, a portion 22 in which the heater coil member is fused and mixed in the sheath member can be formed to be present in only a portion inside the sheath 14 and separated from the surface layer portion of the sheath 14 in the closing portion 21 for closing the distal end portion of the sheath 14. In addition, the closing portion 21 obtained by melting only the sheath member consisting of, e.g., stainless steel is formed outside the fused portion 22. Therefore, the heat resistance and durability can be increased to be much higher than those obtained by conventional methods.

The present inventors manufactured a sheath heater 15 under the conditions described above and performed a durability test of the obtained sheath heater 15. As a result, it was confirmed that the sheath heater 15 according to the present invention was able to withstand the durability test more than 60,000 times which was about twice the number of repetition times against which conventional products could withstand. FIG. 4A shows the state of the distal end portion of the sheath 14 before the durability test; and FIG. 4B, that after the test. According to the sheath heater 15 of the present invention, since the closing portion 21 consisting of mostly the sheath member is present, the fused portion 22 of the sheath member with respect to the heater coil can be covered with a wall having a sufficient thickness. Although a thin oxide layer 23 is formed inside the sheath 14, this layer has no influence on the durability of the sheath heater 15. That is, it is obvious that the method of the present invention has a conspicuous advantage.

Figure 4B:
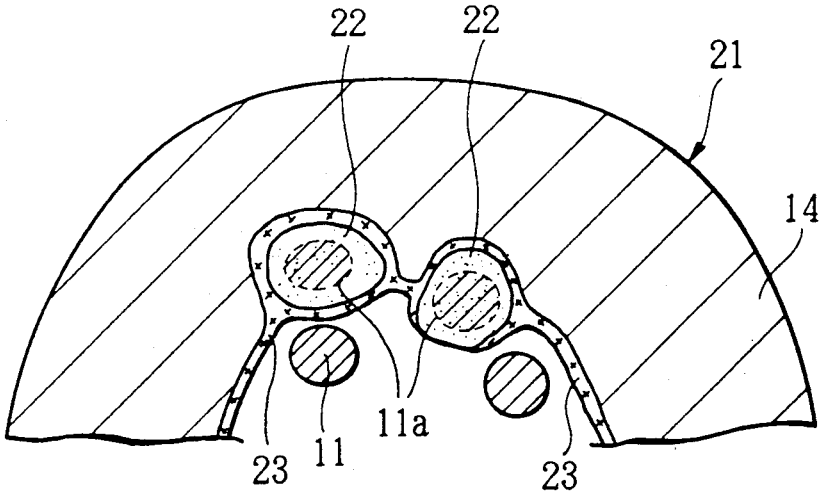
Figure 5:
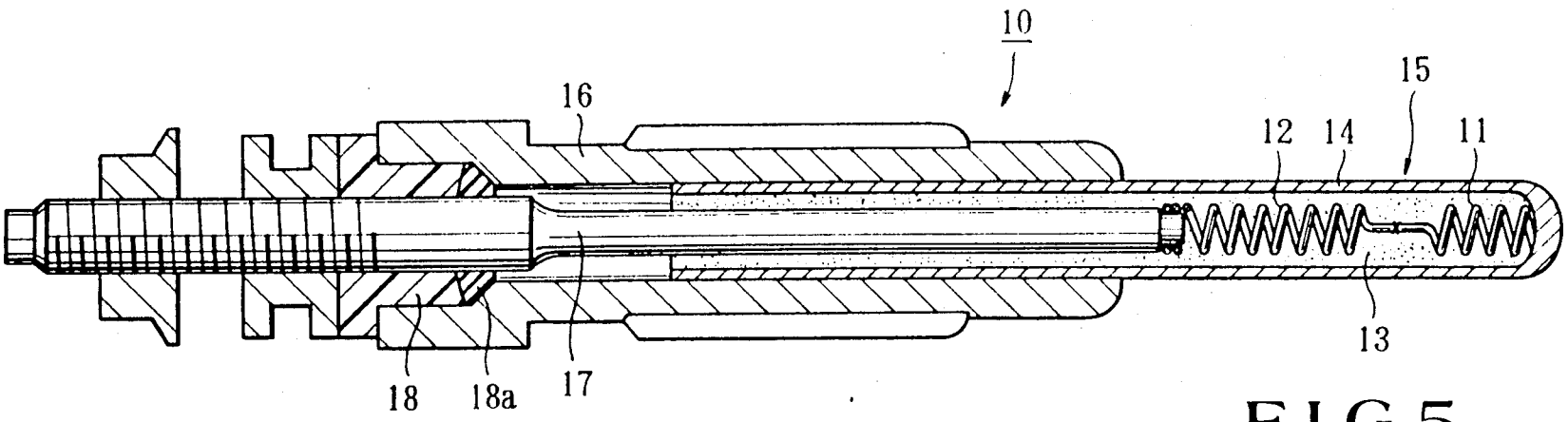
FIG. 5 is a schematic sectional view for explaining an arrangement of the entire glow plug.
Figure 6A:
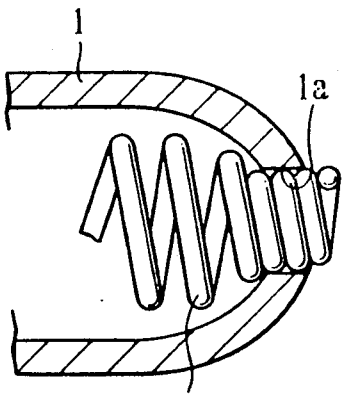
FIG.6A PRIOR ART
FIGS. 6A, 6B, and 6C are enlarged sectional views for explaining a main part of a conventional example.
Figure 6B:
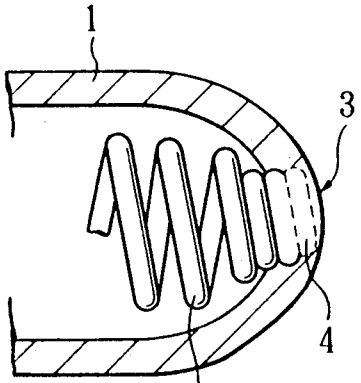
FIG.6B PRIOR ART
Figure 6C:
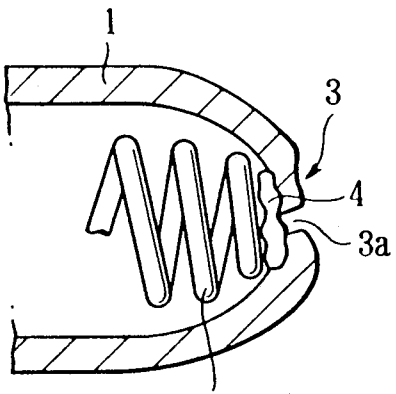
FIG.6C PRIOR ART
Figure 7A:
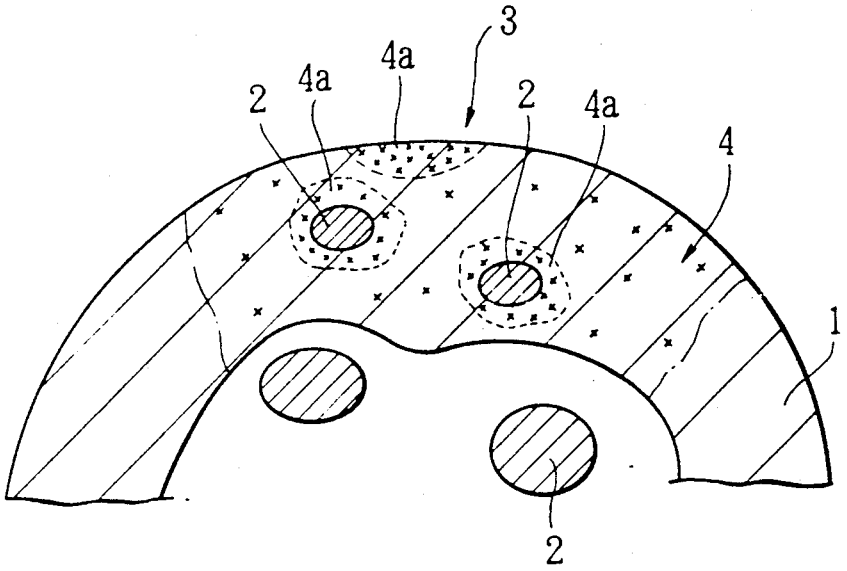
FIG.7A PRIOR ART
FIGS. 7A and 7B are enlarged views for explaining states of a sheath distal end portion obtained before and after a durability test.
Figure 7B:
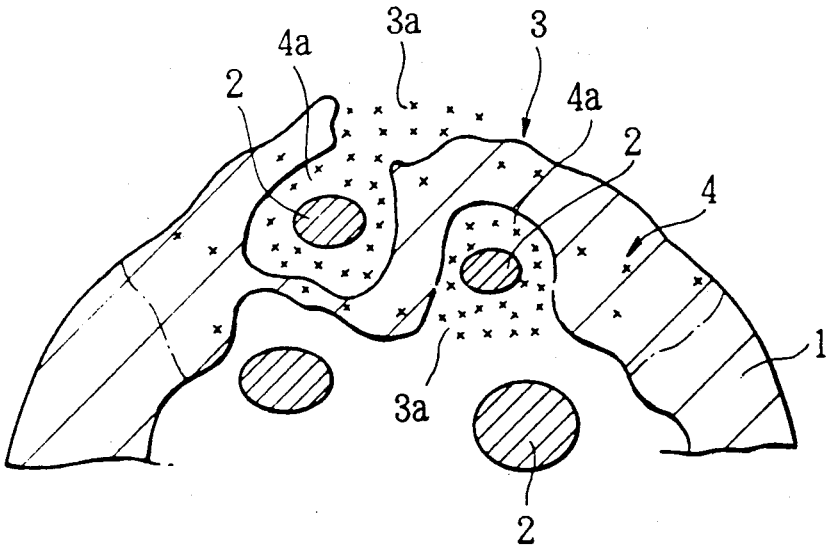
FIG.7B PRIOR ART

Note that FIG. 4B or 7B described above shows a texture based on a texture photograph showing a section of the distal end portion of the sheath 14 of the glow plug 10 subjected to a durability test conducted at a cycle of, e.g., a power supply (11V) interval of 10 seconds and a pause of 30 seconds (during which rapid air cooling is performed). In the glow plug according to the present invention shown in FIG. 4B, no damage having an influence on durability was found even after the durability test was repeated 60,000 times or more. However, in the glow plug according to a conventional method shown in FIG. 7B, holes were formed by oxidation after the test was repeated about 30,000 times. That is, an obvious difference is present between the present invention and this conventional product.

In addition, although a method as disclosed in Japanese Patent Laid-Open No. 63-96420 can be used as the welding method of connecting the sheath 14 and the heater coil 11 and closing the distal end portion of the sheath 14, the welding method is not limited to this method. Also, the type of welding is not limited to the plasma welding described above but may be electron-beam welding or laser welding.

The present invention is not limited to the structure of the above embodiment, but the shape and the structure of each part of the glow plug 10 can be arbitrarily changed and modified. For example, in the above embodiment, the sheath heater 15 is described by taking a so-called two-material structure in which the heater coil 11 and the resistive element 12 for power control are buried as an example. However, the present invention is not limited to this embodiment but can be effectively applied to a sheath heater 15 of one material type having only a heater coil 11, which is conventionally generally used. That is, the present invention can be applied to any structure in which a heater coil 11 is connected and fixed to the distal end portion of a sheath 14 by welding.

In the above embodiment, the heater coil 11 consists of an iron-chromium alloy, and the present invention is effective especially when this material is used. However, the material is not limited to this alloy but may be a nickel-chromium alloy. When a nickel-chromium alloy is used, although a decrease in Ni concentration in the fused portion with respect to the sheath cannot be prevented, the essential effect of the present invention of improving the durability in the coil connection portion at the distal end of the sheath can be achieved.

As has been described above, according to the sheath heater for use in a diesel engine glow plug and a method of manufacturing the same according to the present invention, a small-diameter cylindrical portion into which the distal end of a heater coil is inserted and welded is formed in the distal end portion of a metal sheath, and the heater coil connected to the sheath distal end portion is inserted from inside the sheath such that its distal end portion does not project outside from the sheath and is located inside the end face of the cylindrical portion. In this state, the small-diameter cylindrical portion is melted by plasma welding or the like from outside the sheath distal end portion to bury the distal end portion of the heater coil in a closing portion for closing the sheath distal end portion such that the heater coil distal end portion is not exposed on the outer surface of the sheath distal end portion. Therefore, regardless of the simple arrangement and connecting method, the heater coil distal end portion can be easily, properly, and reliably connected and fixed to the sheath distal end portion by welding. In addition, the present invention can solve the conventional problem of reduction in durability caused by oxidation which occurs when an unnecessarily large amount of the heater coil member is melted and contained in the sheath member. As a result, the heat resistance or durability can be largely improved compared to those of conventional products, and the performance as a sheath heater can be effectively achieved.

What is claimed is:

1. A sheath heater comprising:

a metal sheath having a closed distal end and formed to have a substantially tubular shape as a whole;

a coil-like heater housed in said sheath; and a heat-resistant electrically insulating powder, charged in said sheath, for holding said coil-like heater in said sheath with said coil-like heater electrically insulated from said sheath, a distal end portion of said coil-like heater being buried in a melted portion of said closed distal end of said sheath so as not to be exposed on an outer wall thereof.

2. A heater according to claim 1, wherein said coil-like heater consists of an iron-chromium alloy, and said sheath consists of stainless steel.

3. A heater according to claim 1, wherein said coil-like heater is connected in series with a resistive element having a resistance temperature coefficient larger than that of said coil-like heater.

4. A method of manufacturing a sheath heater comprising a metal sheath having a closed distal end and formed to have a substantially tubular shape as a whole, a coil-like heater housed in said sheath, and a heat-resistant electrically insulating powder, charged in said sheath, for holding said coil-like heater in said sheath with said coil-like heater insulated from said sheath, said method comprising the steps of:

providing a metal sheath element having a small-diameter tubular cylindrical portion at a distal end thereof:

inserting a distal end portion of a coil-like heater into the small-diameter portion of said sheath so that the distal end portion of said coil-like heater does not project outside said sheath and is located inside an end face of said cylindrical portion: and melting said small-diameter cylindrical portion by welding from outside the distal end portion of said sheath to close the distal end portion of said sheath while the distal end portion of said coil-like heater is electrically connected to said sheath, thereby melting at least part of the small-diameter portion of said sheath and burying the distal end portion of said coil-like heater so as not to be exposed on an outer wall at the distal end of said sheath.

5. A method according to claim 4, wherein said step of inserting includes the step of providing a coil-like heater consisting of an iron-chromium alloy, and wherein said step of providing includes the step of using a sheath element consisting of stainless steel.

6. A method according to claim 4, wherein said step of inserting includes the step of providing a combination element comprising the coil-like heater connected in series with a resistive element having a resistance temperature coefficient larger than that of said coil-like heater.

7. A method according to claim 4, wherein said welding is plasma welding.

8. A method according to claim 4, wherein said welding is electron-beam welding.

9. A method according to claim 4, wherein said welding is laser welding.

* * * * *

UNITED STATES PATENT AND TRADEMARK OFFICE
Certificate

Patent No. 5,118,921 Patented: June 2, 1992

On petition requesting issuance of a certificate for correction of inventorship pursuant to 35 U. S. C. 256, it has been found that the above-identified patent, through error and without deceptive intent, improperly sets forth the inventorship.

Accordingly, it is hereby certified that the correct inventorship of this patent is: Takashi Aota and Teruo Oouchi.

Signed and Sealed this Ninth Day of December, 1997.

BRUCE A. REYNOLDS
*Supervisory Patent Examiner*
Art Unit 2106